US005897288A

United States Patent [19]

Green

[11] Patent Number: 5,897,288

[45] Date of Patent: Apr. 27, 1999

[54] HANGER FOR LIFT TRUCK

[75] Inventor: Alan E. Green, Guelph, Canada

[73] Assignee: Cascade (Canada) Ltd., Mississauga, Canada

[21] Appl. No.: 08/995,940

[22] Filed: Dec. 22, 1997

[30] Foreign Application Priority Data

Dec. 20, 1996 [CA] Canada ..... 2193580

[51] Int. Cl.[6] ..... B66F 9/12

[52] U.S. Cl. ..... 414/785; 187/237

[58] Field of Search ..... 187/237; 414/785, 414/607, 608, 667, 671; 254/2 R, DIG. 4

[56] References Cited

U.S. PATENT DOCUMENTS

| | | | |
|---|---|---|---|
| 2,975,924 | 3/1961 | Kopanski . | |
| 3,027,033 | 3/1962 | Schuster . | |
| 4,113,128 | 9/1978 | Foss | 414/667 XL |

FOREIGN PATENT DOCUMENTS

| | | | |
|---|---|---|---|
| 556031 | 4/1957 | Belgium | 414/667 |
| 1405352 | 5/1965 | France | 414/667 |
| 3227354 | 2/1983 | Germany | 414/607 |
| 243017 | 2/1987 | Germany | 414/785 |
| 802614 | 10/1958 | United Kingdom . | |
| 1507585 | 4/1978 | United Kingdom . | |
| 2017046 | 10/1979 | United Kingdom . | |
| 2023537 | 1/1980 | United Kingdom . | |

*Primary Examiner*—Frank E. Werner
*Attorney, Agent, or Firm*—Bereskin & Parr

[57] ABSTRACT

A fork for a fork lift truck is attached to the typical mast mounted carriage by means of upper and lower hangers. Lateral adjustment of the position of the fork relative to the carriage involves engagement and release of a pin structure carried by the upper hanger. The upper hanger incorporates a pin which is vertically movable between a first position in which the pin engages slots in the upper mounting bar of the carriage and a second position in which the pin is recessed permitting lateral, relative movement between the fork and the carriage. A spring urges the pin to the first position where the pin engages slots in then carriage mounting bar. By lifting and turning the pin can be held in a second position so that the fork is slidable laterally along the carriage mounting bar.

12 Claims, 7 Drawing Sheets

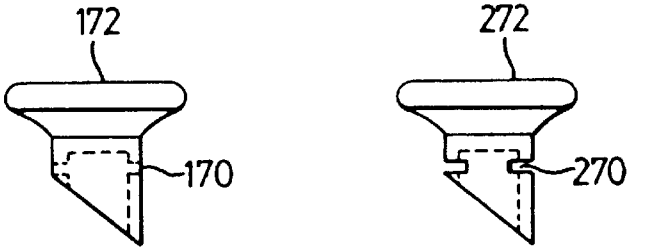
FIG. 6A
FIG. 6B
FIG. 6C
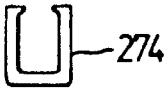
FIG. 6D
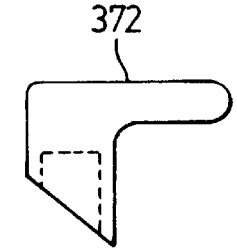
FIG. 6E
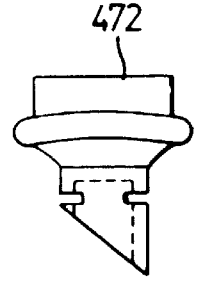
FIG. 6F

HANGER FOR LIFT TRUCK

FIELD OF THE INVENTION

This invention relates generally to forks for material handling trucks and more particular to devices to enable changes in the lateral location of the fork with respect to the carriage of the material handling truck.

BACKGROUND OF THE INVENTION

Fork lift trucks typically have a mast. A carriage is attached to the mast. The material handling vehicle has powered means for elevating the carriage along the mast. In order to carry loads, a generally L-shaped fork is attached to the carriage. In many instances two such forks are attached to the carriage and loads are carried by inserting the forks into a pallet or other convenient device on which the goods to be handled are positioned. In other instances, the goods themselves can be directly contacted by one or more forks. When carrying articles which are relatively long and tubular such as rolled carpets a single fork may be used to carry the load.

With the variety of configuration and spacing of loads to be carried on fork lift trucks, it is common to provide a means for the adjustment of the location of the forks with respect to the carriage. If the desired load is to be picked up with two forks then the spacing between the forks may need to be adjusted to accommodate the particular pallet or other configuration of the load to be carried. Where a single fork is to be used such as in dealing with carpet rolls then one of the forks may be removed from the vehicle and the single fork would then typically be moved to the centre of the vehicle to evenly distribute the load on the vehicle wheels.

Typically the carriage which travels vertically up and down the mast comprises upper and lower mounting bars. When installing forks on a carriage having upper and lower mounting bars, the forks are normally provided with a pair of hook shaped hangers. The hangers extend toward the mast, that is, away from the load supported on the blade of the fork. The hanagers will usually extend vertically with the upper hanger extending downwardly over the upper mounting bar and the lower hanger extending upwardly over the lower mounting bar.

Typically, the upper mounting bar will be provided with a series of locating elements. These may be in the form of holes or slots in the upper mounting bar. Some type of interengaging structure such as a pin is provided to engage with the slots or holes in the upper mounting bar. Conventionally, the pin assemblies which engage with the holes in the upper mounting bar of the carriage, require additional parts to be welded to the hanger or make use of some type of relatively unsophisticated lever action which can be damaged in use.

It is apparent therefore that there is a need for a simplified device which provides positive locking action to maintain the fork in its desired lateral location. It is also desired that the device may work directly with the hanger rather than being separately formed and welded to the hanger.

SUMMARY OF THE INVENTION

An upper hanger for mounting a lift truck fork to an elevatible lift truck carriage of the type having upper and lower mounting bars is provided. The fork comprises a blade and a shank. The fork has an upper hanger. The upper hanger has a first surface for contacting the upper mounting bar of the carriage. The hanger comprises a pin for moving in a generally vertical direction between a first position in which the pin projects from the hanger to engage the upper mounting bar and a second position in which the pin is recessed within the hanger so that the pin does not engage the mounting bar. The hanger comprises guide means to guide the pin for longitudinal movement between the first and second positions as well as biassing means to urge the pin to the first position. The hanger also comprises a second surface which is remote from the first surface with the pin extending through the second surface. The second surface is located at an angle to the direction of longitudinal movement of the pin. The pin includes a boss. The boss has first retaining means while the hanger has second retaining means. The first retaining means and the second retaining means interengage for releasably retaining the pin in the second position.

DESCRIPTION OF THE DRAWINGS

Preferred embodiments of the invention are described below with reference to the attached drawings, in which:

FIG. 6A illustrates the boss of the hanger shown in FIG. 4A;

FIG. 6B shows an alternative structure for the boss as illustrated in FIG. 6A;

FIG. 6C illustrates a further alternative structure for the boss as shown in FIG. 6A;

FIG. 6D illustrates a clamp for use with the boss of FIG. 6C;

FIG. 6E shows an alternate structure to the boss as shown in FIG. 6A;

FIG. 6F illustrates a further alternative of the boss as shown in FIG. 6A.

Figure 1:
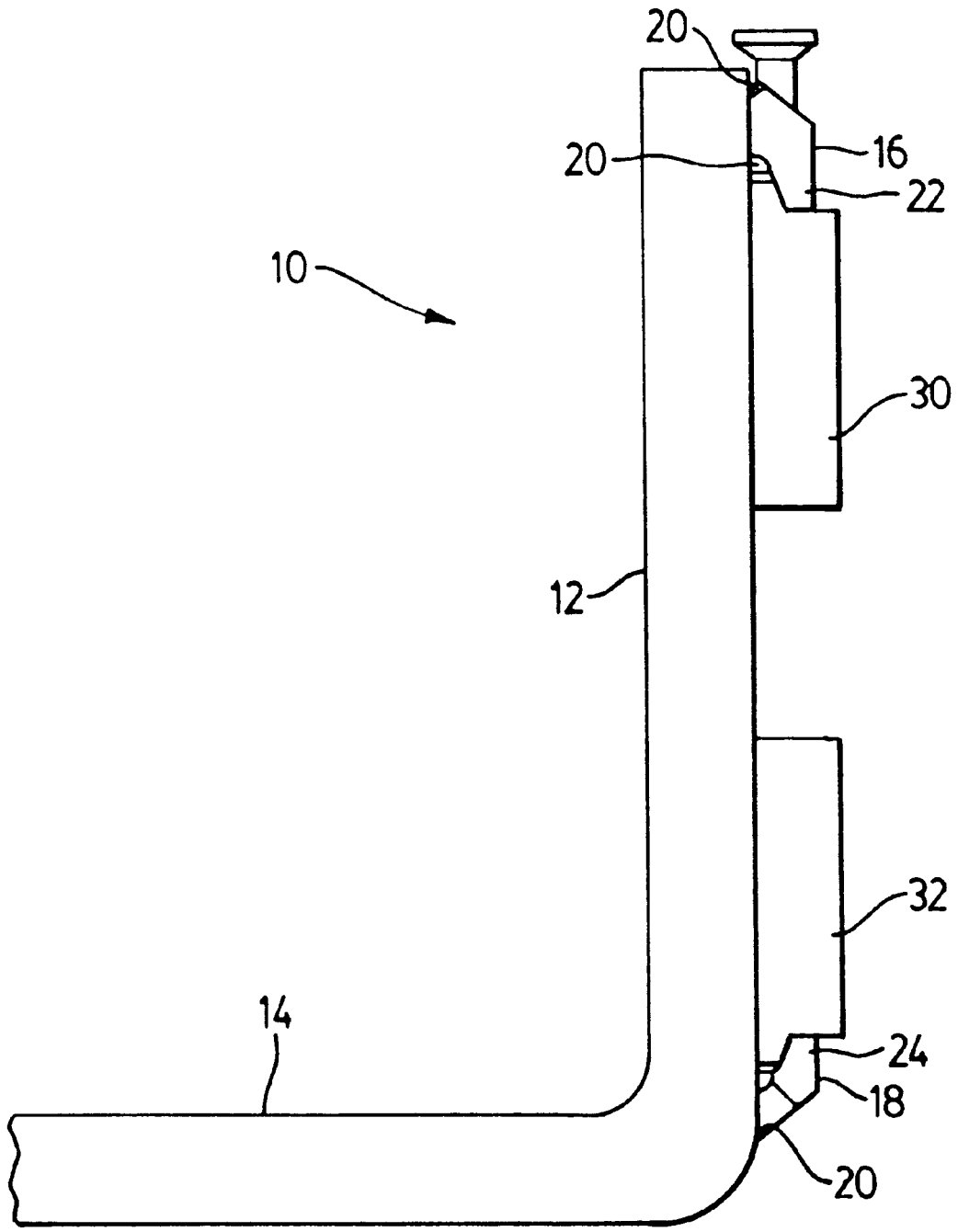
FIG. 1 is a schematic side view of a fork in accordance with a preferred embodiment of the invention illustrating the attachment between the fork and the mounting bars of a carriage.

The fork 10 illustrated generally in FIG. 1 comprises a substantially vertical shank 12 and a substantially horizontal blade 14. Attached to the shank 12 there is an upper hanger 16 and a lower hanger 18. The hangers 16 and 18 may be attached to the shank 12 such as by welding. The welds are shown at 20 in FIG. 1.

The hangers 16 and 18 comprise portions which extend from the back of the shank that is away from the blade and toward the carriage of the material handling vehicle typically a lift truck vehicle.

The hanger 16 comprises a hook 22 which extends downwardly to engage an upper mounting bar 30 of the lift truck vehicle. The lower hanger 18 also comprises a hook 24 which engages a lower mounting bar 32 of the lift truck vehicle. The two mounting bars 30 and 32 are attached to the carriage of the lift truck vehicle. The remainder of the carriage and the mast to which the carriage is affixed are not shown as these do not form part of the current invention. The structure of the carriage, its supporting mast and the means for elevating the carriage may all follow typical designs.

Figure 2:
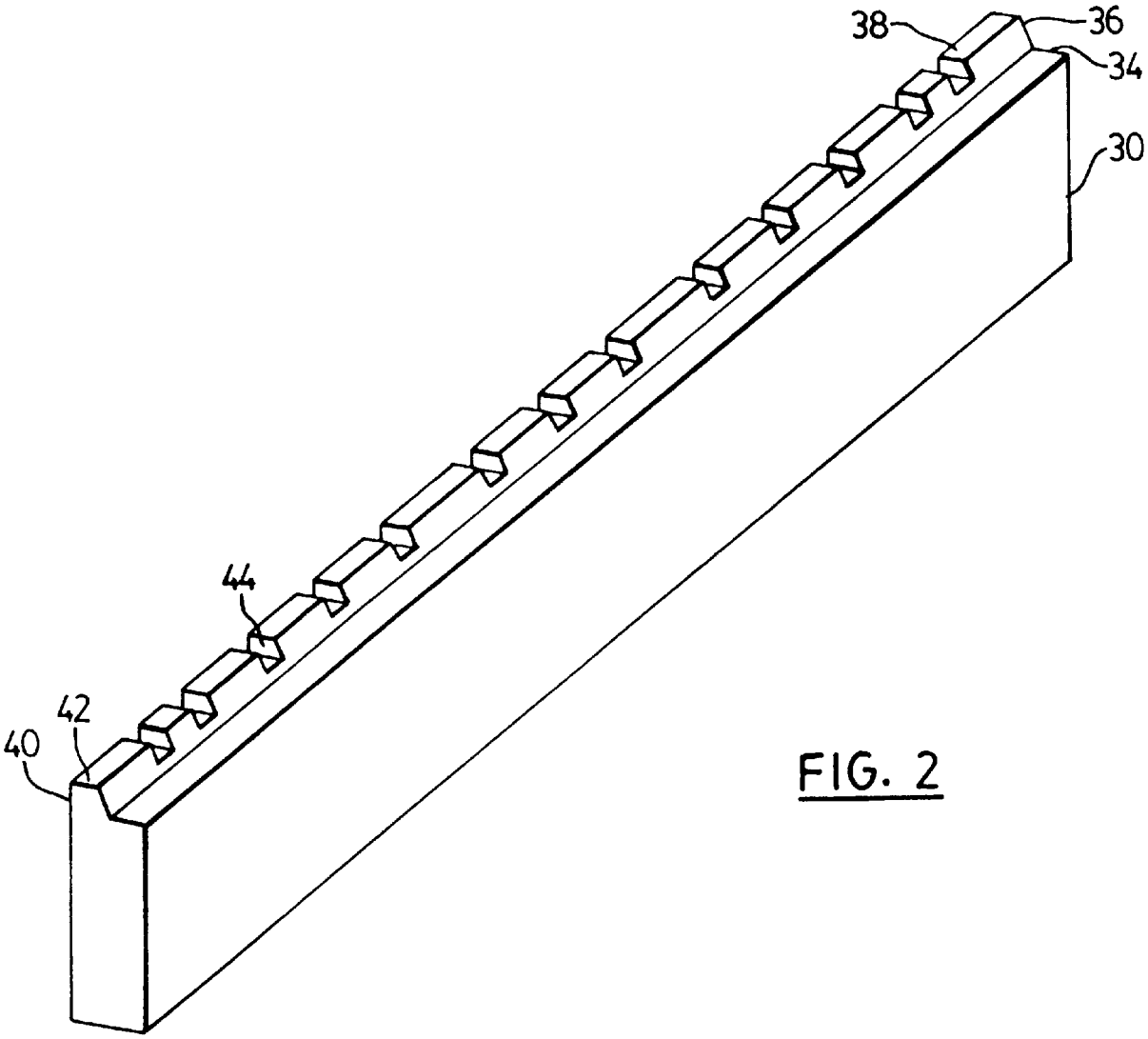
FIG. 2 is a perspective view of the upper mounting bar of the carriage as illustrated in FIG. 1.

FIG. 2 illustrates the upper mounting bar 30 of the material handling vehicle carriage. The upper mounting bar comprises a substantially horizontal surface 34, a surface 36 extending at a slight angle to surface 34 and a surface 38 which extends substantially horizontally. The two surfaces 36 and 38 together with the forward facing surface 40 of the mounting bar define a rib 42 extending along the top edge of the mounting bar 30. The rib 42 is provided with a plurality of slots 44. The slots 44 act as positioning stops to provide a plurality of fixed locations for the location of forks along the mounting bar.

Figure 3:
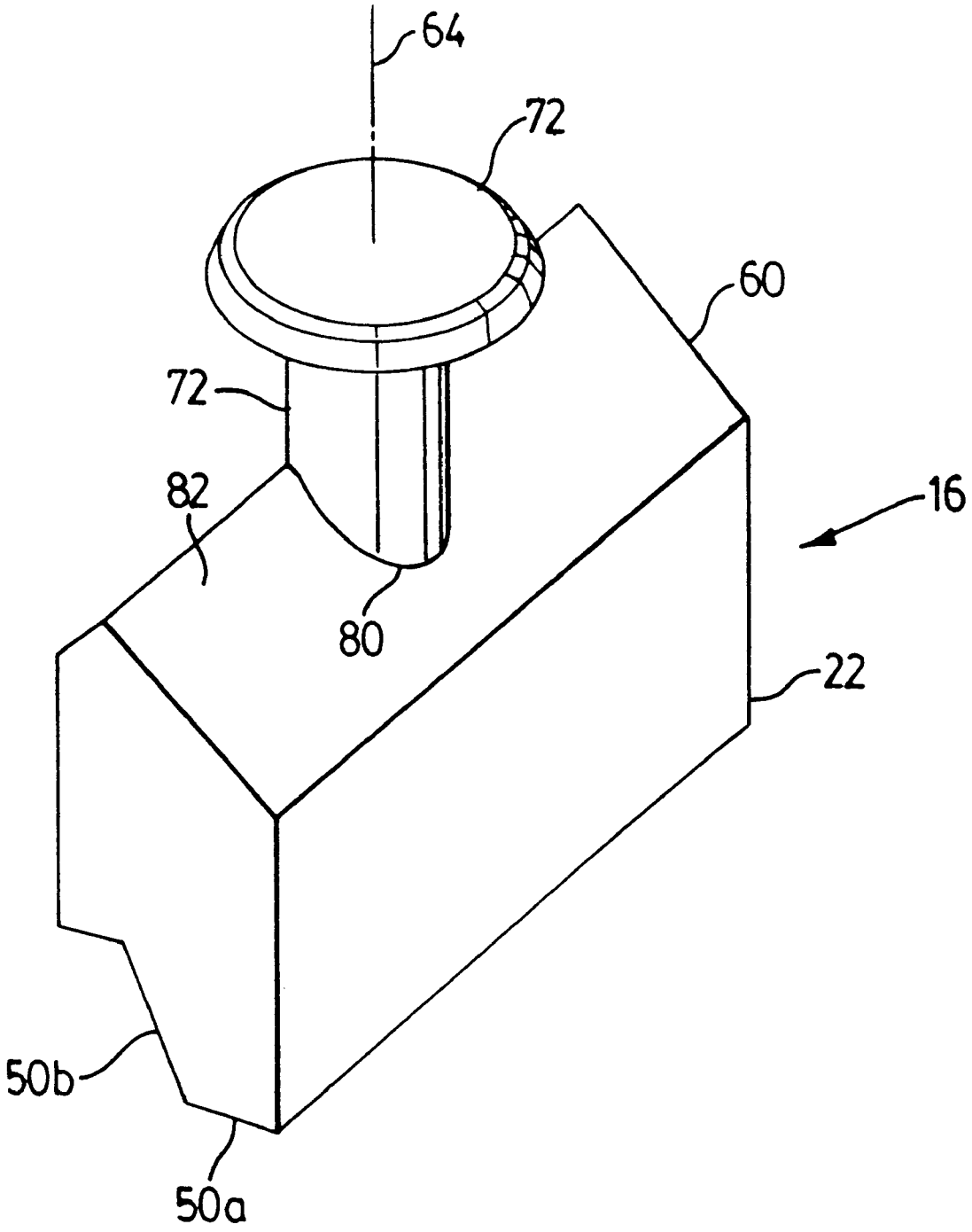
FIG. 3 is a perspective view of the upper hanger of the fork of FIG. 1.
Figure 4B:
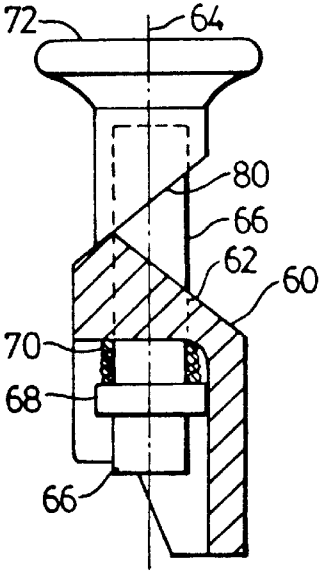
FIG. 4B is a view the same as FIG. 4A but with the pin in a second position.

FIG. 3 illustrates the upper hanger 16 prior to welding the upper hanger 16 to the shank 12 of the fork 10. The hook 22 defines a first surface 50A and 50B. The surface 50A and 50B contacts the surfaces 34 and 36 of the mounting bar 30 shown in FIG. 2. The angle between surfaces 50A and 50B is the same as the angle between surfaces 34 and 36 of the mounting bar 30. The upper hanger 16 comprises a body 60. The body 60 defines a bore 62 which extends generally vertically through the body 60. The bore defines an axis 64 for guided longitudinal movement of a pin 66 shown in FIG. 4A and 4B. The pin 66 is movable from a first position shown in FIG. 4A to a second position shown in FIG. 4B. The pin comprises a land 68. A spring 70 acts between the land 68 and the body 60 of the hanger 16 to bias the pin to the first position shown in FIG. 4A. To move the pin to the second position as shown in FIG. 4B, the spring must be compressed as shown in FIG. 4B.

The pin advantageously includes a boss 72. The pin may be threaded at its upper end as shown in FIG. 5A at 76. The boss 72 may also have an internal thread 78 as shown in FIG. 6A so that the pin 66 may be threaded into the boss 72.

The pin 66 as illustrated in FIG. 5A is most advantageously round in cross-sectional configuration. Thus, the pin may be rotated about the axis 64 as desired. However, the pin may also have other configurations such as square, rectangular and the like. Where the pin is round, the boss may be attached to the pin so that the boss rotates relative to the pin or so that the boss does not independently rotate relative to the pin. As will be explained subsequently, where the pin is not round, it is advantageous to affix the boss to the pin to permit relative rotation between the pin and the boss. To assist assembly of the pin and spring, the boss is a separate piece. Where other assembly structure is available the boss may be a part of the pin.

Alternate forms of pin, boss configuration are shown in other figures. FIG. 5B illustrates a pin 166 that may be used in association with a boss 172 illustrated in FIG. 6B. Rather than using threads to connect the boss to the pin, a pin may be passed horizontally through the wall 168 illustrated in FIG. 5B. Aligned apertures 170 may be provided in the boss 172 and a pin may then be force fit into the aligned aperture to connect the boss 172 to the pin 168.

Figure 5C:
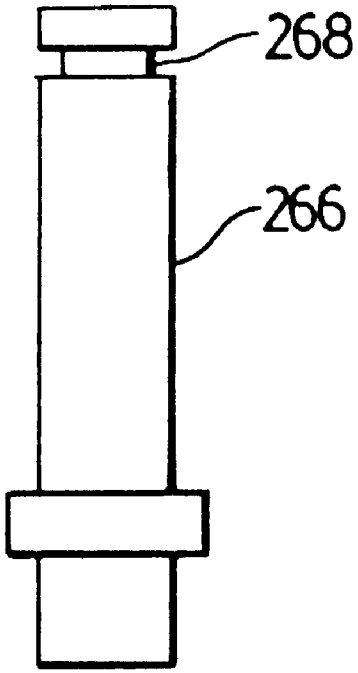
FIG. 5C is a view similar to FIG. 5A showing a further alternative structure for the pin shown in FIG. 5A.
Figure 5B:
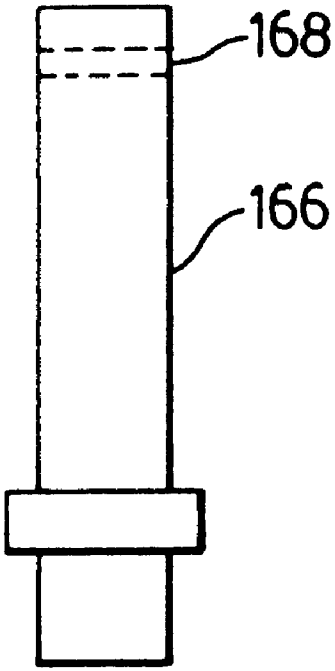
FIG. 5B is a view similar to the view of FIG. 5A but showing an alternative structure for the pin.
Figure 5A:
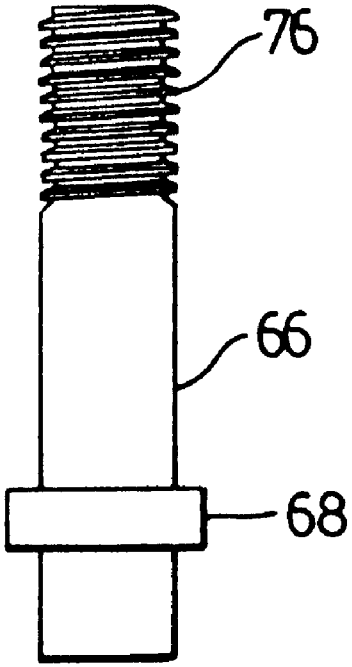
FIG. 5A is a view of a pin of the hanger of FIG. 4A.
Figure 7:
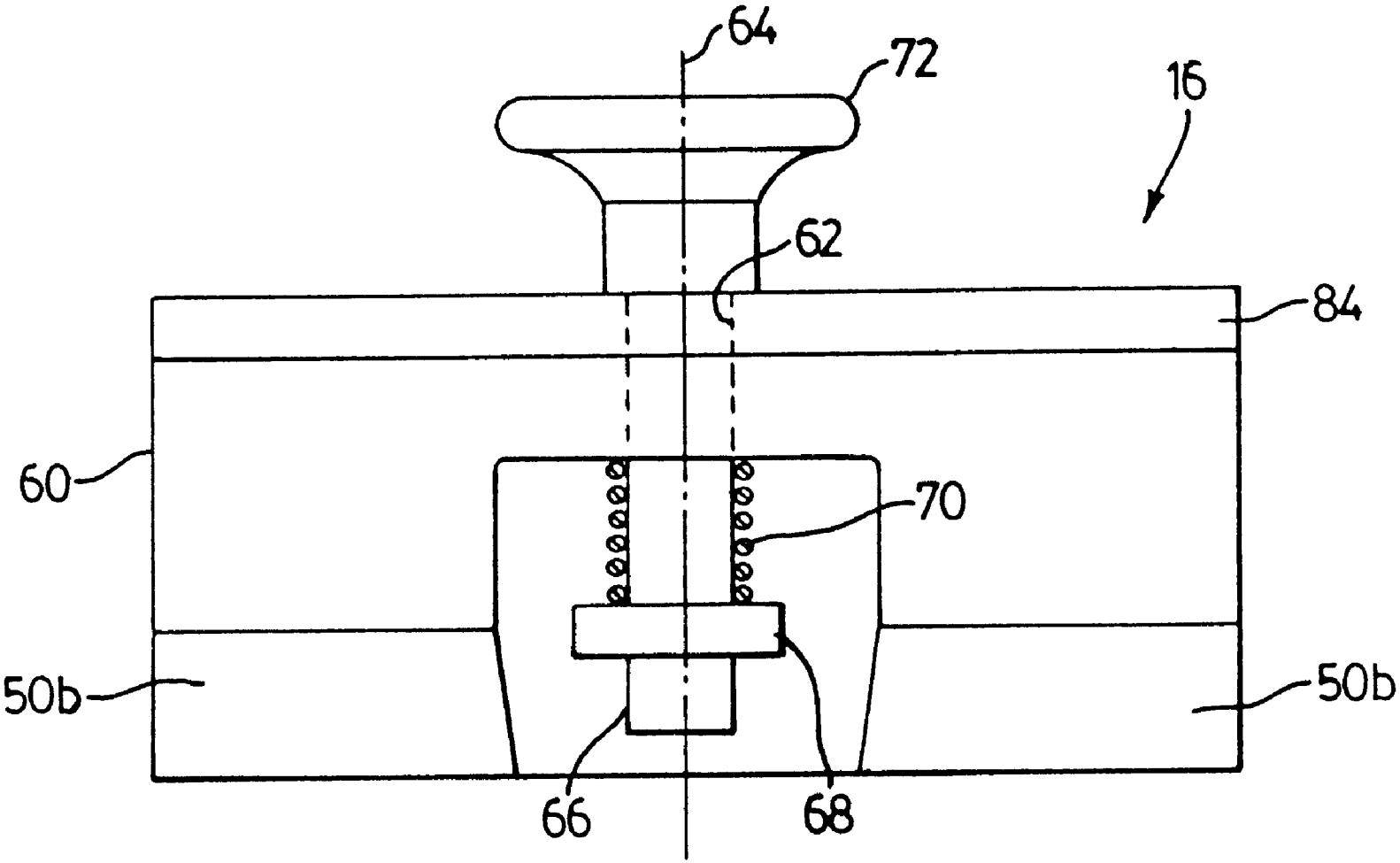
FIG. 7 is a rear view of the hanger of FIG. 3.

Pin 266 illustrated in FIG. 5C involves a groove 268 at the upper portion thereof. The pin 266 may be used in association with the boss 272 illustrated in FIG. 6C. The boss 272 has a groove 270 which in use is aligned with the groove 266. A U-shaped clamp 274 illustrated in FIG. 6D may be used to connect the boss 272 and the pin 268. A connection of this type would then permit relative rotation between the boss 272 and the pin 266. Pin 266 may therefore be circular in its cross-sectional configuration or rectangular or indeed any other shape of convenience.

Alternate forms of bosses 372 and 472 are illustrated in FIG. 6E and 6F respectively. The boss 372 does not have a circular top but rather a side handle extending from one portion of the boss. The boss 472 comprises a twist knob configuration at its upper portion. The connection between the bosses 372 and 472 and their respective pins may use any of the connections previously discussed in association with FIGS. 6A, 6B, 6C and 5A, 5B and 5C.

Figure 4C:
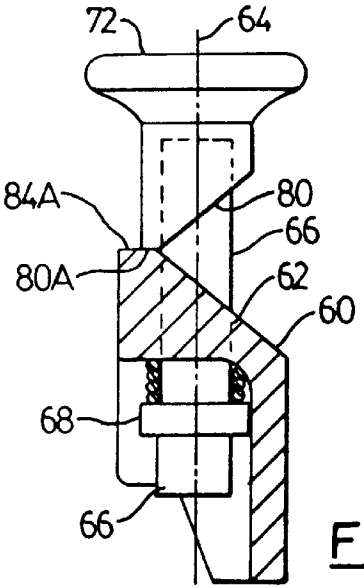
FIG. 4C is a view similar to FIG. 4B, but showing an alternate embodiment.
Figure 4A:
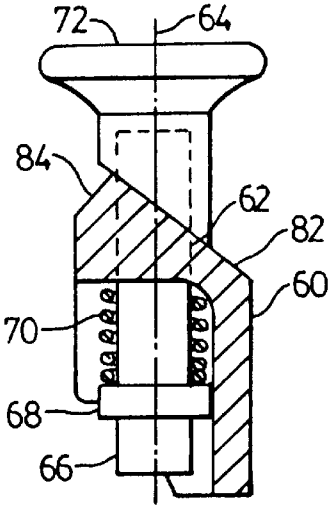
FIG. 4A is a vertical sectional view of the hanger of FIG. 3 with the pin in a first position.

As illustrated in FIGS. 3, 4A and 4B, the boss 72 comprises a surface 80. The surface 80 is an essentially planar surface formed by passing a plane at an angle to the axis 64.

The housing 60 of the upper hanger comprises a second surface 82. The pin 66 extends beyond the surface 82 when the pin is in both the first position and the second position. When the pin is in the first position as shown in FIG. 4A, the pin 66 projects from the hanger 16 so that it may engage with one of the slots 44. With the pin 66 engaging with the slot 44 then horizontal relative movement between the hanger and the mounting bar 30 is not possible. Thus, with the pin in the first position the fork 10 cannot be moved laterally relative to the hanger 30.

When the pin is in the second position as shown in FIG. 4B, the pin is recessed within the body 60 of the hanger 16. With the pin in the recessed position then the hanger and the fork to which the hanger is welded may be moved horizontally relative to the mounting bar 30 for positioning as desired. When the fork is in the desired position the pin is allowed to move to the first position.

In order to facilitate maintaining the pin in the second position the boss 72 interacts with the body 60 of the hanger to maintain the pin 66 in the second position when the parts are aligned in a particular configuration.

As seen in FIG. 3, the hanger 60 comprises an auxiliary surface 84. The interreaction between the surface 80 of the boss 72 and the surfaces 82 and 84 of the hanger can be appreciated from review of FIGS. 4A and 4B.

When the pin is in the first position as shown in FIG. 4A the surface 80 of the boss 72 lies in contact with the surface 82 of the hanger body 60. Thus the surface 80 provides a contact surface for contacting the surface 82. This limits downward movement of the pin 66 under the urging of the spring 70 as shown in FIG. 4A.

When it is desired to move the pin to the position shown in FIG. 4B, the boss 72 is grasped by hand. The boss is pulled upwardly by hand while rotating the boss through 180°. As shown in FIG. 4, surface 80 of the boss 72 extends from the upper left, downwardly to the lower right. When turned 180° as shown in FIG. 4B, the surface 80 extends from the upper right to the lower left. When in that orientation the surface 80 may then engage with the surface 84. Once the surface 80 of the boss 72 interengages with the surface 84, any downwardly movement of the pin 66 under urging of the spring 70 as shown in FIG. 4B, is eliminated. Thus, with the boss turned as shown in FIG. 4B, the pin is retained in the second position. In this manner the contact surface 80 comprises the first retaining means while the auxiliary surface 84 comprises a second retaining means. The first and second retaining means interengage to maintain the pin in the second position despite the urging of the spring 70. As shown in FIG. 4B, when the fork has been moved to the desired position, the boss is rotated through 180° to the orientation shown in FIG. 4A. The spring will then urge the pin to the first position as shown in FIG. 4A thus preventing any further horizontal movement of the fork relative to the mounting bar 30.

As shown the surfaces 82 and 84 of the body 16 may intersect with the axis 64 at the same acute angle. This means that surface 80 will then bear on the surface 84 through whatever area is provided by surface 84 and that portion of surface 80. However, as an alternative, surface 84 need not extend at the same acute angle to the longitudinal axis 64. If the surface 84 intersects the axis of longitudinal movement 64 at right angles, for example, pin 66 will still be retained in its second position. This is illustrated in FIG. 4C. Surface 84A is substantially horizontal. For co-operation with surface 84A, boss 72 may advantageously be provided with horizontal surface 80A.

Desirably, the upper hanger 60 should be in a configuration so that it may be forged. Forging of the block of material is considerably cheaper than machining a cast block. Forged material will also have the strength typically required in lift fork components. All of the surfaces explained above may be comprised in a forging operation. The bore 62 may be formed during the forging operation. The techniques of forging such parts are well known to those familiar with this art.

It is intended that the foregoing description be interpreted as illustrative rather than in a restrictive sense. Accordingly, variations to the structures described herein may be apparent to persons skilled in the art of lift truck forks in adapting the present invention to specific applications. It is intended that this specification intend to cover any such variations insofar as they are within the spirit and scope of the following claims.

I claim:

1. An upper hanger for mounting a lift truck fork to an elevatable lift truck carriage, said carriage having upper and lower mounting bars, said fork having a blade and a shank, and said upper hanger is, in use, fixed to said shank of said fork, said upper hanger comprising a first surface for contacting said upper mounting bar for said carriage, said upper mounting bar having a plurality of slots, said hanger comprising:

a pin for moving in a generally vertical direction between a first position in which said pin projects from said hanger to engage with one of said slots of said upper mounting bar and a second position in which a portion of said pin is recessed within said hanger, so that said pin does not engage said mounting bar, so that said fork may be moved along said mounting bars of said carriage, said hanger comprising guide means to guide said pin for longitudinal movement between said first and second positions, and biasing means to urge said pin to said first position, said hanger comprising a second surface remote from said first surface, said pin extending through said second surface and said second surface is located at an acute angle to the direction of said longitudinal movement of said pin, said pin including a boss, said boss having a generally planar contact surface for contacting said second surface of said hanger when said pin is in said first position, said boss having first retaining means, said hanger having second retaining means and said first retaining means and said second retaining means, inter-engaging after rotation of said boss about said direction of longitudinal movement when said pin is moved to said second position from said first position, for releasably retaining said pin in said second position.

2. The device of claim 1 wherein said first retaining means of said boss comprises at least a portion of said contact surface.

3. The device of claim 2 wherein said second retaining means of said hanger includes an auxiliary surface for contacting at least a portion of said contact surface of said boss when said pin is in said second position.

4. The device of claim 3 wherein said auxiliary surface is generally perpendicular to the direction of longitudinal movement of said pin.

5. The device of claim 3 wherein said auxiliary surface is generally planar and forms an acute angle with the direction of longitudinal movement of said pin and said angle of said surface is equal and opposite to said angle of said second surface to said direction of travel.

6. The device of claim 3 wherein said boss is rotatably affixed to said pin.

7. The device of claim 6 wherein said pin is fixed against rotation relative to said hanger.

8. The device of claim 7 wherein said pin is rectangular.

9. The device of claim 8 wherein said boss includes a circular handle.

10. The device of claim 9 wherein said boss includes said handle projecting away from the direction of longitudinal movement of said pin.

11. The device of claim 6 wherein said pin is round.

12. The device of claim 1 wherein said second retaining means of said hanger includes an auxiliary surface for contacting at least a portion of said contact surface of said boss when said pin is in said second position.

* * * * *